United States Patent [19]

Manzonelli et al.

[11] 4,093,475

[45] June 6, 1978

[54] METHOD OF CASTING ALUMINUM BASE ALLOY SHEET AND PRODUCT

[75] Inventors: Carmen C. Manzonelli, Coraopolis, Pa.; Joseph L. Tessandori, Owensboro, Ky.

[73] Assignee: National Steel Corporation, Pittsburgh, Pa.

[21] Appl. No.: 755,950

[22] Filed: Dec. 30, 1976

[51] Int. Cl.[2] ..... C22C 21/16; B22D 11/06; B22D 21/04

[52] U.S. Cl. ..... 148/32; 75/141; 75/142; 148/2; 148/11.5 A; 164/88

[58] Field of Search ..... 75/138, 142, 143, 141; 148/32, 32.5, 2, 11.5 A; 164/88

[56] References Cited

U.S. PATENT DOCUMENTS

| | | | |
|---|---|---|---|
| 3,219,492 | 11/1965 | Anderson et al. | 75/138 |
| 3,930,895 | 1/1976 | Moser et al. | 148/32 |

*Primary Examiner*—R. Dean

*Attorney, Agent, or Firm*—Shanley, O'Neil and Baker

[57] ABSTRACT

In continuous casting of aluminum base alloy in sheet form where the alloy comprises small but effective amounts of silicon, iron, manganese, magnesium and copper, an objectionable amount of edge cracking has occurred in the product. This has necessitated side trimming the sheet with the resultant cost of the edge shearing operation and wasted energy in melting the scrap. Applicants have discovered that by increasing the iron and manganese contents of the alloy and decreasing the silicon and magnesium contents, edge cracking can be eliminated or reduced to the point where edge shearing can be eliminated or significantly reduced.

4 Claims, No Drawings

METHOD OF CASTING ALUMINUM BASE ALLOY SHEET AND PRODUCT

BACKGROUND OF THE INVENTION

In casting aluminum base alloys directly into sheet form by various methods, including that carried out in the Hunter caster (see U.S. Pat. No. 2,790,216), it has been common to experience edge cracking of the sheet as it issues from the caster. The cracks in the edges extend into the sheet and are of a character such that during ensuing cold reduction of the sheet, the cracks propagate inwardly. As a result, it has been considered necessary to edge shear continuously cast sheet aluminum based alloys of the 3105 Aluminum Association classification and others. This means that the scrap sheared off the edges of the sheet represents wasted energy consumed in melting the aluminum alloy going into the scrap. Additionally the cost of the edge shearing operation plus the recycling of the scrap both involve additional expense.

Applicants have sought to eliminate edge cracking in aluminum based alloys, such as the Aluminum Association 3105 alloy and the new 3007 alloy, without deleteriously affecting the physical properties, the shape and the surface of the final cold reduced product. The applicants have accomplished this desideratum by merely increasing or decreasing certain alloying constituents while correspondingly decreasing or increasing others.

SUMMARY OF THE INVENTION

The method of the present invention involves the forming of aluminum based alloy sheet material which is characterized by reduction in edge cracking and a resultant elimination of or significant reduction in the necessity for edge shearing, the method comprising forming a melt of aluminum base alloy consisting essentially of the following composition: silicon from about 0.06 to about 0.30%, iron from about 0.45 to about 0.70%, manganese from about 0.35 to about 0.80%, magnesium from about 0.01 to about 0.29%, copper from about 0.10 to about 0.30% and the balance aluminum plus inconsequential amounts of other elements, and continuously casting the aluminum base alloy in sheet form.

The present invention also involves an aluminum base alloy sheet which has been continuously cast in sheet form consisting essentially of the following composition: silicon from about 0.06 to about 0.30%, iron from about 0.45 to about 0.70%, manganese from about 0.35 to about 0.80%, magnesium from about 0.01 to about 0.29%, copper from about 0.10 to about 0.30% and the balance aluminum plus inconsequential amounts of other elements.

DESCRIPTION OF THE INVENTION

Aluminum based alloys cast in sheet form, for example Hunter cast strip, normally has a cracked edge that is regarded as one of the typical features of the as cast product. This cracked edge requires an intermediate edge trim before the final rolling. When the microstructure of such a cracked edge is examined, it is apparent that the cracking is intergranular indicating that the cracking is taking place at a relatively high temperature, above the equi-cohesive temperature. The equi-cohesive temperature is the temperature above which a metal fails in the grain boundaries and below which it fails through the grains. This is a property of the metal and can be distinguished from failure caused by a weak second phase in the grain boundary.

Hunter continuous cast sheet, for example, is normally cast with a cracked edge that opens up during cold rolling, requiring a special trim operation on the cold mill. The trim is normally $\frac{3}{4}$ inch per side on the third cold mill pass. This $1\frac{1}{2}$ inch total extra trim is in excess of the finish width trim required for sale. An average Hunter caster produces approximately ten million pounds per year of cast sheet requiring an extra $1\frac{1}{2}$ inch trim. Based on an average width of cast sheet of 51 inch, the elimination of extra trim would represent approximately 3% savings in material. Where the side trim must be made the scrap amounts to 300,000 pounds of extra non-usable trim per caster per year which must be recycled at a loss.

In the past, it has been concluded that the metallurgy and chemistry of the strip were not the cause of good or bad edge conditions. Comparison of chemical analyses with the cracking behavior of aluminum based alloys failed to establish significant relationships. This result seemed to be confirmed by the fact that there was uniform cracking of all Hunter cast alloys. Additionally it was thought that the normal variation of alloy composition and of alloys cast would have shown the operators the important chemical variables long ago if chemistry was the answer. Finally, the fact that good and bad edges can appear on opposite edges of the same strip would seem to negate any argument for chemistry being the cause.

In the past, a number of attempts have been made to eliminate edge cracking. First air was blown on the edge of the solidifying sheet. It was hoped that prefreezing the edge of the sheet prior to the freezing of the center would prevent lateral stress from occurring and thereby eliminate the cracking. Actually this increased the edge cracking. Thereupon experiments were conducted of heating the solidifying cast edges with a blow torch. No beneficial results were obtained.

Although prior knowledge indicated that the metallurgy and chemistry of the aluminum base alloys were not the cause of good or bad edge condition, applicants decided to experiment with the 3105 aluminum base alloy to determine whether or not varying the proportions of alloying elements could achieve a reduction or elimination of edge cracking in the continuous casting of sheet product. As a result of their experimentation, applicants discovered that by selectively reducing the magnesium and silicon contents and selectively increasing the iron and manganese contents, a product having a crack-free edge could be produced. They also discovered that as the iron and manganese contents were selectively increased, the silicon and magnesium contents did not have to be reduced to the same extent and vice versa. Thus where the practical aspects of making up the melt for casting resulted in high silicon content in the melt, the iron and/or manganese could be increased to compensate. Additionally they discovered that in the latter situation, instead of relying solely on increasing the iron and/or manganese to compensate for the high silicon, the magnesium content could be reduced to achieve smooth edges. Of course, the desired physical properties of the final sheet product must also be kept in mind in balancing these alloying elements.

In their experimentation, it was applicants' intent to decrease the magnesium content and hold the silicon content as low as practicable, consistent with the available alloying constituents, for example in scrap, going to make up the molten metal, while at the same time bringing up the iron and manganese content of the melt in order to maintain physical property levels. Applicants found that with very low silicon, for example about 0.06% and conventional amounts of magnesium, iron and manganese, a coil ran with 100% smooth edge. However, operating day to day with such low silicon contents in the melt can be difficult, control of the iron, manganese and/or magnesium contents of the melt being more practical. In some situations it is difficult to get the magnesium down to what is occasionally a desirable content of about 0.01% but this can be done by known methods. Where the silicon and magnesium are low and/or the iron high, applicants have found that the manganese can go as low as about 0.35%. A satisfactory iron content was found to range between about 0.45 and about 0.75%, a satisfactory silicon content to range between about 0.06 and about 0.30%, a satisfactory manganese content to range between about 0.35 and about 0.75% and a satisfactory magnesium content to range between about 0.01 and about 0.29%. Copper is usually present up to about 0.30% with a favorable range being between about 0.10 and about 0.15%.

Other alloying constituents can be present which do not affect the present invention.

Table I shows the results of 25 sample castings with the first ten showing cracked edges and the remaining fifteen having smooth edges.

TABLE I

Edge Condition Composition Data

| Cracked Edges | | % Composition (By Weight) | | | | | | | | |
|---|---|---|---|---|---|---|---|---|---|---|
| Sample No. | Cast Number | Si | Fe | Cu | Mn | Mg | Cr | Zn | Ti | Na |
| 1 | 3-8-5-4A | .14 | .52 | .11 | .42 | .29 | .01 | .04 | .029 | <.0001 |
| 2 | 2-8-6-1A | .14 | .54 | .11 | .43 | .28 | .01 | .04 | .027 | <.0001 |
| 3 | 1-8-6-1A | .15 | .56 | .12 | .45 | .26 | .01 | .04 | .028 | .0001 |
| 4 | 222021 | .08 | .43 | .12 | .50 | .30 | <.01 | .02 | .007 | .0001 |
| 5 | 222019B | .10 | .52 | .14 | .48 | .30 | <.01 | .02 | .015 | .0001 |
| 6 | 112179 | .26 | .50 | .12 | .40 | .27 | | — | .021 | <.0001 |
| 7 | 112180 | .16 | .46 | .10 | .36 | .26 | | — | .015 | <.0001 |
| 8 | 112184C | .16 | .62 | .15 | .50 | .25 | | — | .013 | .0001 |
| 9 | 223070 | .22 | .58 | .12 | .39 | .33 | .02 | .05 | .050 | .0007 |
| 10 | 223065 | .24 | .58 | .12 | .37 | .30 | .02 | .05 | .042 | <.0001 |
| 11 | 112181 | .08 | .58 | .12 | .45 | .12 | — | | .016 | <.0001 |
| 12 | 112182 | .08 | .66 | .15 | .57 | .09 | | | .017 | <.0001 |
| 13 | 112183 | .15 | .71 | .14 | .53 | .11 | | | .019 | .0001 |
| 14 | 113764 | .21 | .65 | .11 | .51 | .02 | .02 | .06 | .044 | <.0001 |
| 15 | 113765 | .22 | .67 | .12 | .52 | .02 | .02 | .06 | .052 | .0002 |
| 16 | 113769 | .24 | .61 | .12 | .46 | .16 | .02 | .05 | .044 | <.0001 |
| 17 | 113771 | .23 | .60 | .12 | .46 | .12 | .02 | .05 | .046 | .0001 |
| 18 | 112034 | .04 | .57 | .11 | .43 | .27 | <.01 | .014 | .011 | <.0001 |
| 19 | 3-86-1A | .13 | .47 | .10 | .46 | .16 | .01 | .03 | .025 | <.0001 |
| 20 | 3-85-4A | .14 | .52 | .11 | .42 | .29 | .01 | .04 | .029 | <.0001 |
| 21 | 2-8-62A | .13 | .47 | .10 | .47 | .15 | .01 | .03 | .023 | <.0001 |
| 22 | 2-1-21-5 | .15 | .51 | .15 | .40 | .46 | .01 | .03 | .030 | .0002 |
| 23 | 2-2-4-4 | .08 | .48 | .12 | .44 | .25 | <.01 | .02 | .017 | .0001 |
| 24 | 113761 | .18 | .62 | .12 | .57 | .01 | .01 | .06 | .025 | <.0001 |
| 25 | 223050 | .26 | .67 | .13 | .46 | .29 | .02 | .08 | .056 | — |

It will be noted from the table that where the magnesium is high the iron and manganese must also be high in order to avoid edge cracks and further that where the magnesium is high and the iron and manganese are not, a low silicon content can prevent edge cracking.

It will also be evident from Table I that with silicon and magnesium at the most practical levels, i.e. with silicon between about 0.10 and about 0.20% and magnesium between about 0.10 and about 0.20%, the more easily controlled iron and manganese contents can be maintained within the ranges of about 0.50 and about 0.65% for the former and about 0.45 and about 0.65% for the latter. Thus these ranges would be the optimum for day by day operation.

We claim:

1. The method of forming aluminum based alloy sheet material continuously cast in sheet form characterized by elimination or reduction in edge cracking and a resultant elimination of or significant reduction in the necessity for edge shearing comprising forming a melt of aluminum base alloy consisting essentially of the following composition: silicon from about 0.06 to about 0.30%, iron from about 0.45 to about 0.70%, manganese from about 0.35 to about 0.80%, magnesium from about 0.01 to about 0.29%, copper from about 0.10 to about 0.30% and the balance aluminum plus inconsequential amounts of other elements in which melt when the silicon and/or magnesium are on the low side of their ranges the iron and/or manganese are on the high side of their ranges, when the silicon is on the high side of its range the magnesium is on the low side of its range or the iron and/or manganese are on the high side of their ranges, when the magnesium is on the high side of its range the iron and manganese are on the high side of their ranges and when the magnesium is on the high side of its range and the iron and manganese are not on the high side of their ranges the silicon is on the low side of its range, and continuously casting the aluminum base alloy in sheet form.

2. The method of claim 1 wherein the silicon is between about 0.10 and about 0.20%, the magnesium is between about 0.10 and about 0.20%, the iron is between about 0.50 and about 0.65%, and the manganese is between about 0.45 and about 0.65%.

3. An aluminum base alloy sheet which has been continuously cast in sheet form characterized by elimination or reduction in edge cracking and a resultant elimination of or significant reduction in the necessity for edge shearing consisting essentially of the following composition:

silicon from about 0.06 to about 0.30%, iron from about 0.45 to about 0.70%, manganese from about 0.35 to about 0.80%, magnesium from about 0.01 to about 0.29%, copper from about 0.10 to about 0.30% and the balance aluminum plus inconsequential amounts of other elements in which composition when the silicon and/or magnesium are on the low side of their ranges the iron and/or manganese are on the high side of their ranges, when the silicon is on the high side of its range the magnesium is on the low side of its range or the iron and/or manganese are on the high side of their ranges, when the magnesium is on the high side of its range the iron and manganese are on the high side of their ranges and when the magnesium is on the high side of its range and the iron and manganese are not on the high side of their ranges the silicon is on the low side of its range.

4. The aluminum base alloy sheet of claim 3 wherein the silicon is between about 0.10 and 0.20%, the magnesium is between about 0.10 and about 0.20%, the iron is between about 0.50 and about 0.65%, and the manganese is between about 0.45 and about 0.65%.

* * * * *